US007227541B2

(12) United States Patent
Ando

(10) Patent No.: US 7,227,541 B2
(45) Date of Patent: Jun. 5, 2007

(54) IMAGE DISPLAY APPARATUS AND METHOD OF DETERMINING CHARACTERISTIC OF CONVERSION CIRCUITRY OF AN IMAGE DISPLAY APPARATUS

(75) Inventor: Muneki Ando, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 615 days.

(21) Appl. No.: 10/762,335

(22) Filed: Jan. 23, 2004

(65) Prior Publication Data

US 2004/0179031 A1 Sep. 16, 2004

(30) Foreign Application Priority Data

Mar. 14, 2003 (JP) ..... 2003-070873

(51) Int. Cl.
*G09G 3/30* (2006.01)

(52) U.S. Cl. ..... 345/204; 345/76; 345/82; 348/607; 348/446; 348/448; 315/169.3

(58) Field of Classification Search ..... 345/55–103, 345/204, 698–699, 208–210; 348/437.1, 348/438.1, 445–448, 607; 315/169.3
See application file for complete search history.

(56) References Cited

U.S. PATENT DOCUMENTS 4,602,273 A * 7/1986 Carlson ..... 348/450
5,091,784 A * 2/1992 Someya et al. ..... 348/589
5,388,081 A * 2/1995 Hashimoto et al. ..... 348/606
5,428,455 A * 6/1995 Hosoya et al. ..... 386/114
5,754,163 A * 5/1998 Kwon ..... 345/611
5,822,008 A * 10/1998 Inoue et al. ..... 348/446
5,903,319 A * 5/1999 Busko et al. ..... 348/607
6,107,983 A * 8/2000 Masuda et al. ..... 345/98
6,970,207 B1 * 11/2005 Seigneret et al. ..... 348/607
7,116,372 B2 * 10/2006 Kondo et al. ..... 348/448
2001/0040537 A1 * 11/2001 Sakai et al. ..... 345/55
2003/0020698 A1 1/2003 Ando ..... 345/204
2004/0125046 A1 * 7/2004 Yamazaki et al. ..... 345/1.3
2004/0160406 A1 * 8/2004 Yamazaki et al. ..... 345/100
2004/0179031 A1 * 9/2004 Ando ..... 345/698

* cited by examiner

*Primary Examiner*—Lun-Yi Lao
(74) *Attorney, Agent, or Firm*—Fitzpatrick, Cella, Harper & Scinto

(57) ABSTRACT

An image display apparatus has an image display including scanning lines, modulation lines and display devices driven through the scanning lines and modulation lines, a scanning circuit for supplying a scanning signal to the scanning line, a modulating circuit for supplying a modulation signal to the modulation line, and a converting circuit for converting the number of scanning lines of an input image signal. In addition, a selecting section selects a scan method of any of a first scan method and a second scan method and a changing section changes a vertical scaling filter characteristic of the converting circuit in accordance with the selected scan method. The vertical scaling filter characteristic in the case of the first scan method is a characteristic having a weaker elimination effect on high frequency components as compared with the vertical scaling filter characteristic in the case of the second scan method.

9 Claims, 14 Drawing Sheets

FIG. 3

| | |
|---|---|
| 1 | a |
| 2 | b |
| 3 | c |
| 4 | d |
| 5 | e |
| 6 | f |

FIG. 4

| | |
|---|---|
| 1 | a |
| 2 | a+b |
| 3 | b+c |
| 4 | c+d |
| 5 | d+e |
| 6 | e+f |

IMAGE DISPLAY APPARATUS AND METHOD OF DETERMINING CHARACTERISTIC OF CONVERSION CIRCUITRY OF AN IMAGE DISPLAY APPARATUS

BACKGROUND OF THE INVENTION

The present invention relates to an image display apparatus for displaying an image on a plane of a device, such as an EL display device, plasma display device or electro-emission type fluorescence display device.

FIG. 15 shows a configuration of a display apparatus in the prior art.

A reference numeral 1 refers to a display panel using a surface conduction type electro-emission device. Scanning lines Dx1 to Dxm in a row direction and modulation lines Dy1 to Dyn in a column direction are arranged in matrix, and electro-emission devices, not shown, are placed on the intersection points of the lines to form m rows and n columns of electro-emission devices. When an electric current flows through this device, electrons are emitted, wherein a non-linear characteristic shown in FIG. 16 is showed. For instance, when a voltage of 16 V is applied to the device, electrons are emitted, but when a voltage of 8 V is applied, almost no electrons are emitted. Then, the emitted electrons are accelerated by accelerating means, not shown, to cause the electrons to impinge on a fluorescent face, not shown, so that light is emitted. In other words, the device to which a voltage of 16 V is applied can emit light, but the application of 8 V that is half of it does not lead to light emission. Therefore, simple matrix driving is possible as shown in FIG. 17.

A reference numeral 2 refers to a scanning driving section. The scanning driving section 2 is comprised of a switching switch 22, a selection potential generating section 23 and a non-selection potential generating section 24. A reference numeral 3 refers to a modulation driving section. The modulation driving section 3 is comprised of a shift resistor 31, a latch 32, a pulse width modulation circuit 33, a driving amplifier 34. A reference numeral 4 refers to a synchronization separating section. A reference numeral 5 refers to an A-D converter. A reference numeral 6 is a driving control circuit for generating a driving control signal. A reference numeral 7 refers to a resolution converting section. A reference numeral 10 refers to an input signal identifying section. A reference numeral 11 refers to an input control section. A reference numeral 12 refers to a resolution converting control section.

A reference symbol S1 refers to an analog video signal inputted to the apparatus. A reference symbol S2 refers to a synchronizing signal separated from the analog video signal S1. A reference symbol S3 refers to a digital video signal obtained by sampling the video signal S1 in the A-D converter 5. A reference symbol S4 refers to a display signal obtained by subjecting the digital video signal to an image processing. A reference symbol S5 refers to a conversion timing signal applied to the A-D converter 5. A reference symbol S6 refers to a conversion parameter for defining an operation of the resolution converting section 7. A reference symbol S7 refers to an image clock signal for controlling an operation of a shift register. A reference symbol S8 refers to a modulation control signal for controlling an operation of the modulation driving section 3. A reference symbol S9 refers to a PWM clock that serves as an operation basis for the pulse width modulation circuit. A reference symbol S10 refers to a scanning control signal for controlling an operation of the scanning driving section. A reference symbol S11 refers to an image type signal obtained by making identification in the input identifying section.

The synchronizing signal S2 extracted from the analog video signal S1 inputted to the apparatus by the synchronization separating section 4 is inputted to the driving control circuit 6 and the input identifying section 10.

The input identifying section 10 measures timing of the synchronizing signal, and identifies a type of the video signal being inputted thereto to output the image type signal S11.

The driving control circuit 6 generates different kinds of driving control signals S7 to S10 on the basis of the synchronizing signal S2 and the image type signal S11.

The input control section 11 outputs a conversion timing signal S5 for operating the A-D converter 5 in accordance with the synchronizing signal S2 and the video kind signal S11.

The A-D converter 5 receives and samples the analog video signal S1 in accordance with the conversion timing signal S5 to output the digital video signal S3.

The resolution converting control section 12 determines different kinds of parameters necessary for the conversion of resolution in accordance with the image type signal S11 to output the conversion parameter S6.

The resolution converting section 7 receives the digital video signal S3, and subjects it to a resolution conversion in accordance with the conversion parameter S6 to output the display signal S4.

An operation in which the display panel 1 is driven by the scanning driving section 2 and the modulation driving section 3. FIG. 18 shows timing in this occasion.

The modulation driving section 3 sequentially inputs the display signal S4 to the shift register 31 in synchronization with the image clock signal S7, and holds the display data in the latch 14 in accordance with a LOAD signal of the modulation control signal S8. Then, responsive to a START signal of the modulation control signal S8, a pulse signal having a pulse width according to the data held in the latch 32 is generated by the pulse width modulation circuit 33 on the basis of the PWM clock S9, and a voltage is amplified to Vm in the amplifier 34 to drive the modulation lines of the display panel 1.

In the way of the above operations, the contents of the input video signal S1 are displayed on the display panel 1.

SUMMARY OF THE INVENTION

In image display apparatuses, especially consumer products, there is generally a tendency to be desired to have a bright displayed image. However, at the same time the consumer products also always require cost-saving strictly, and so the cost reduction is a problem to be resolved, that is permanently demanded. On the other hand, an image quality, in particular a sharpness of a displayed image is an important factor as an index of performance of the image display apparatus. In view of the above-mentioned circumstances, an object of the present invention is to inexpensively provide an image display apparatus that can perform bright and high quality of displayed images.

In order to achieve the above-mentioned object, the present invention is directed to an image display apparatus comprising: image display means including scanning lines, modulation lines and display devices driven through said scanning lines and modulation lines; a scanning circuit for supplying a scanning signal to said scanning line; a modulating circuit for supplying a modulation signal to said modulation line; a converting circuit for converting the number of scanning lines of an input image signal; selecting means for selecting a scan method of any of a first scan method and a second scan method, the first scan method being intended to select a plurality of adjacent scanning lines in the same time during one selection period and select the same scanning line twice or more within one frame while a set of scanning lines that are selected at the same time is changed, the second scan method being adapted to select one scanning line during one selection period and select the same scanning line only once within one frame; and changing means for changing a vertical scaling filter characteristic of said converting circuit in accordance with the selected scan method, wherein said vertical scaling filter characteristic in the case of said first scan method is a characteristic having a weaker elimination effect on high frequency components as compared with said vertical scaling filter characteristic in the case of said second scan method.

By doing so, a vertical scaling filter characteristic of the converting circuit for converting scanning lines of the input video signal is changed in dependence on whether the first scan method or the second scan method is selected, and a vertical scaling filter characteristic in the case of the first scan method is set to a characteristic of a weaker elimination effect on high frequency components as compared with a vertical scaling filter characteristic of the second scan method, whereby it is possible to provide a vertical spatial frequency response characteristic similar to that in the second scan method even in the case where the display apparatus operates in the first scan method, resulting in an inexpensive image display apparatus that can display bright and high-quality images.

The present invention can be arranged as an image display apparatus comprising: image display means including scanning lines, modulation lines and display devices driven through said scanning lines and modulation lines; a scanning circuit for supplying a scanning signal to said scanning line; a modulating circuit for supplying a modulation signal to said modulation line; selecting means for selecting a scan method of any of a first scan method and a second scan method, the first scan method being adapted to select a plurality of adjacent scanning lines in the same time during one selection period and select the same scanning line twice or more within one frame while a set of scanning lines that are selected at the same time is changed, the second scan method being adapted to select one scanning line during one selection period and select the same scanning line only once within one frame; a filter circuit for subjecting image data to be displayed in said image display means to a filtering processing for eliminating high frequency components and supplying the subjected data to said modulation circuit; and changing means for changing an elimination effect on the high frequency components in said filter circuit in accordance with the selected scan method, wherein a characteristic of said filter circuit in the case of said first scan method is a characteristic having a weaker elimination effect on high frequency components as compared with a characteristic of said filter circuit in said second scan method.

In this way, a characteristic of the filter circuit for subjecting the image to a filtering processing is changed in dependence on whether the first scan method or the second scan method is selected, and a characteristic in the case of the first scan method is set to a characteristic of a weaker elimination effect on high frequency components as compared with a characteristic in the case of the second scan method, whereby it is possible to provide a vertical spatial frequency response characteristic similar to that in the second scan method even in the case where the display apparatus operates in the first scan method, resulting in an inexpensive image display apparatus that can display bright and high-quality images.

DESCRIPTION OF THE DRAWINGS

FIG. 3 is a conceptual diagram of a driving method in the prior art.

FIG. 4 is a conceptual diagram of a repetitious scan mode.

DETAILED DESCRIPTION OF THE INVENTION

First Embodiment

Figure 1:
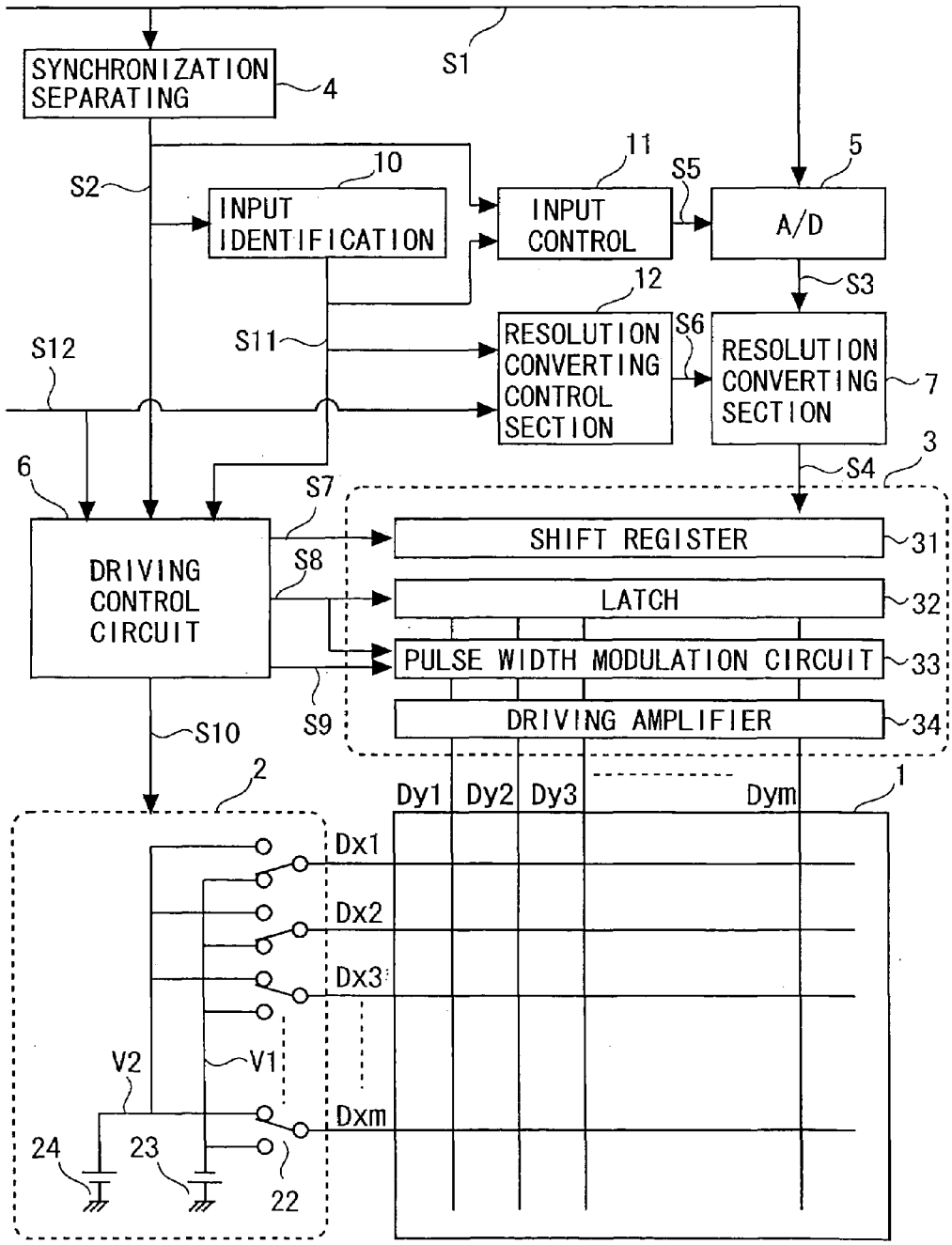
FIG. 1 is a constructional illustration of an image display apparatus to which the present invention is applied.

FIG. 1 shows a configuration of an image display apparatus in a first embodiment of the present invention.

A reference symbol S12 refers to a switching signal inputted from a user interface means or the like, not shown, the switching signal being provided for switching between a normal scan and an overlap scan. A reference numeral 7 refers to a resolution converting section for performing enlargement and reduction of the image. A reference numeral 12 refers to a resolution converting control section.

A driving control circuit section 6 as selecting means generates a scanning control signal S10 according to a normal scan or repetitious scan in accordance with a switching signal S12. A resolution converting control section 12 as changing means generates a conversion parameter S6 suitable to each mode of the normal scan or repetitious scan in accordance with the switching signal S12. How to concretely determine the parameter will be described later.

Figure 15:
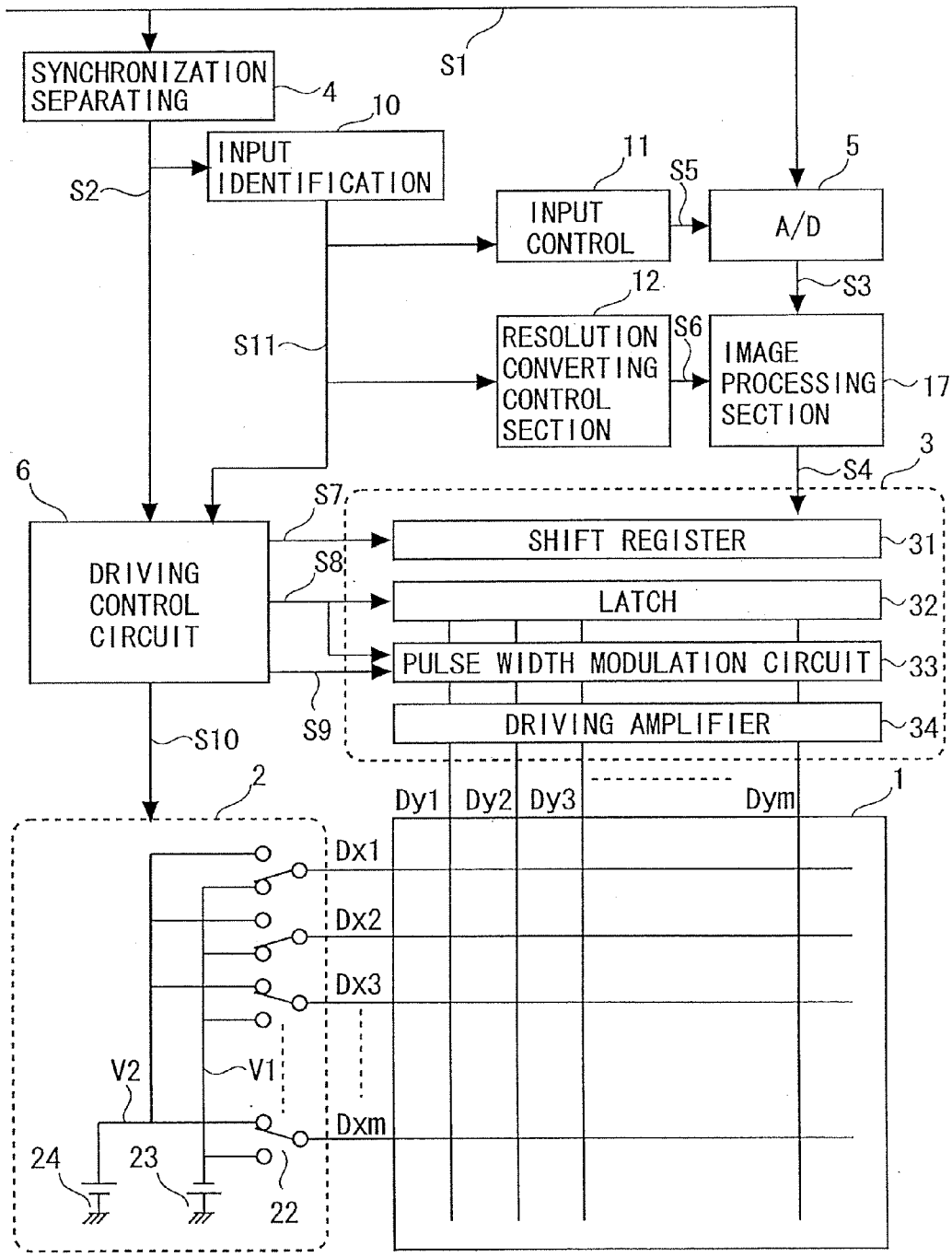
FIG. 15 (PRIOR ART)
FIG. 15 is a structural diagram of an image display apparatus in the prior art.
Figure 16:
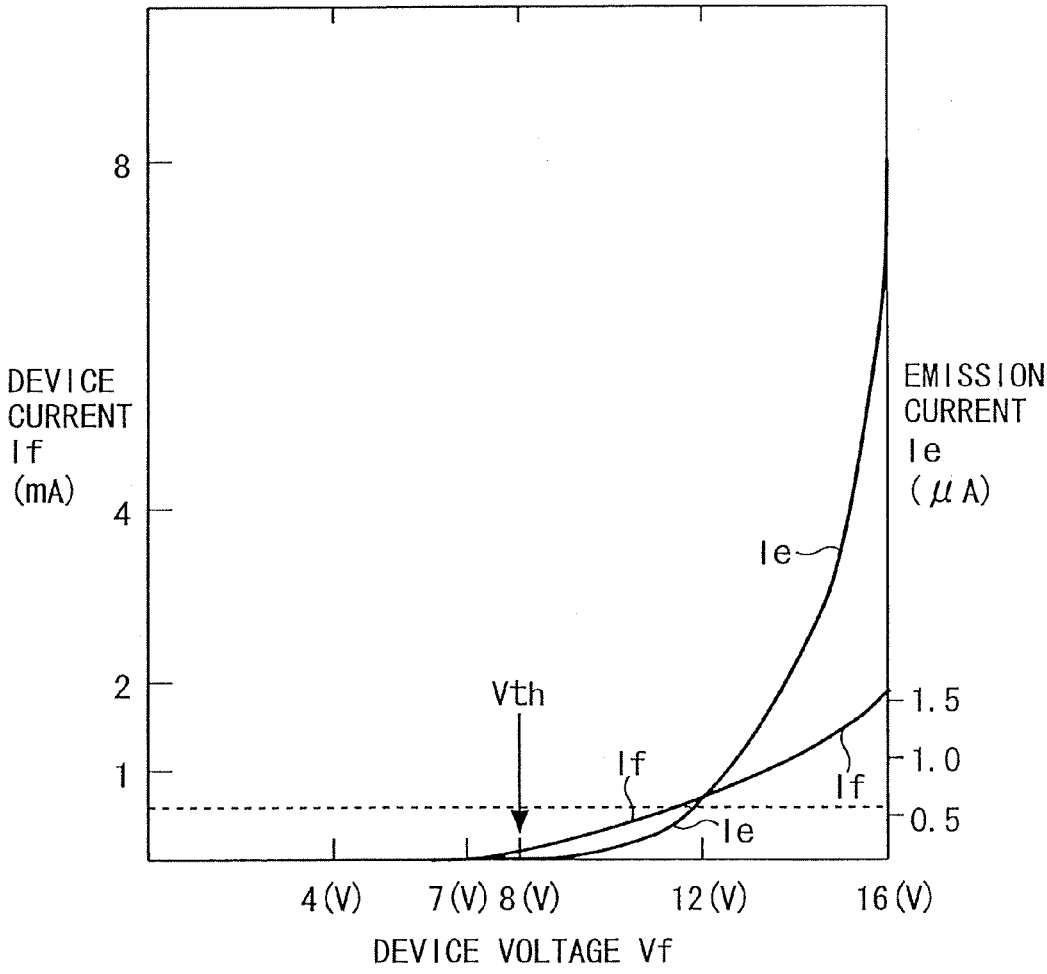
FIG. 16 (PRIOR ART)
FIG. 16 is a graph showing characteristics of an electro-emission device.
Figure 17:
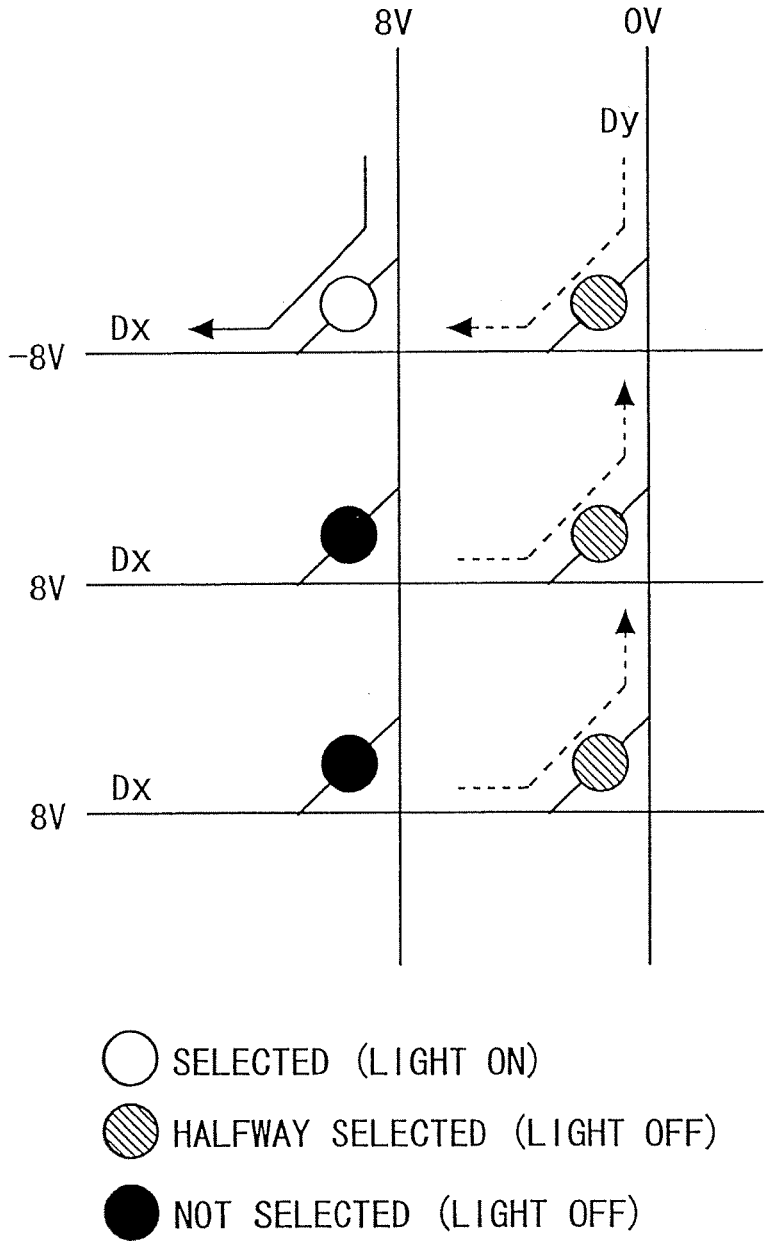
FIG. 17 (PRIOR ART)
FIG. 17 is a conceptual illustration of a simple matrix driving scheme.
Figure 18:
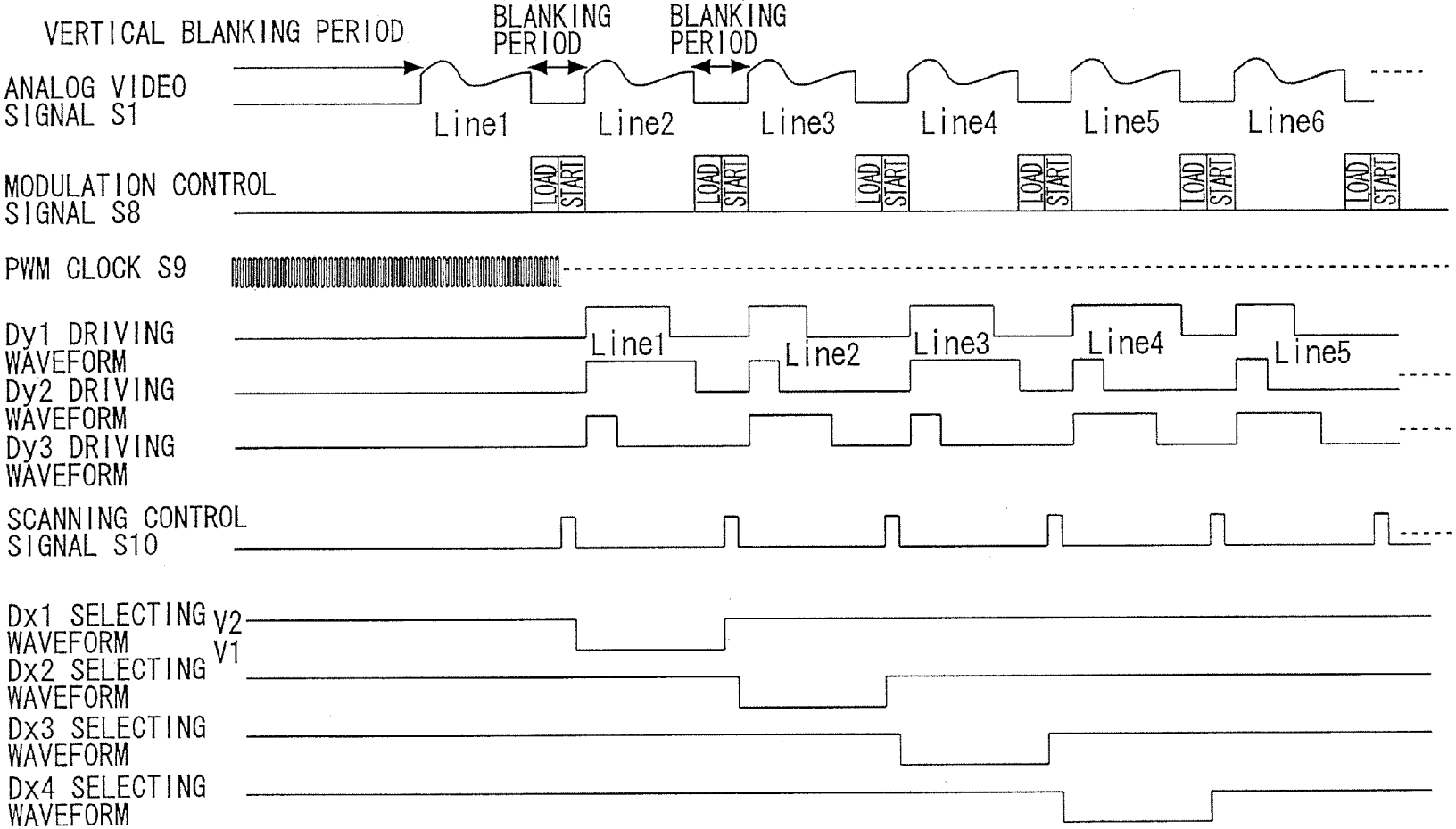
FIG. 18 (PRIOR ART)
FIG. 18 is a timing chart in the prior art.

Other construction and operation is substantially the same as those in the prior art display apparatus shown in FIG. 15. The equivalent structural elements are given the same or much the same reference symbols, and their descriptions will be omitted. Although a kind of fluorescent display devices, including a surface conduction type emissive device, FE (Field Emission) type emissive device, or MIM (Metal-Insulator-Metal) type emissive device are used for the display devices used in the display panel 1, EL device or plasma device may be used for the same.

Figure 2:
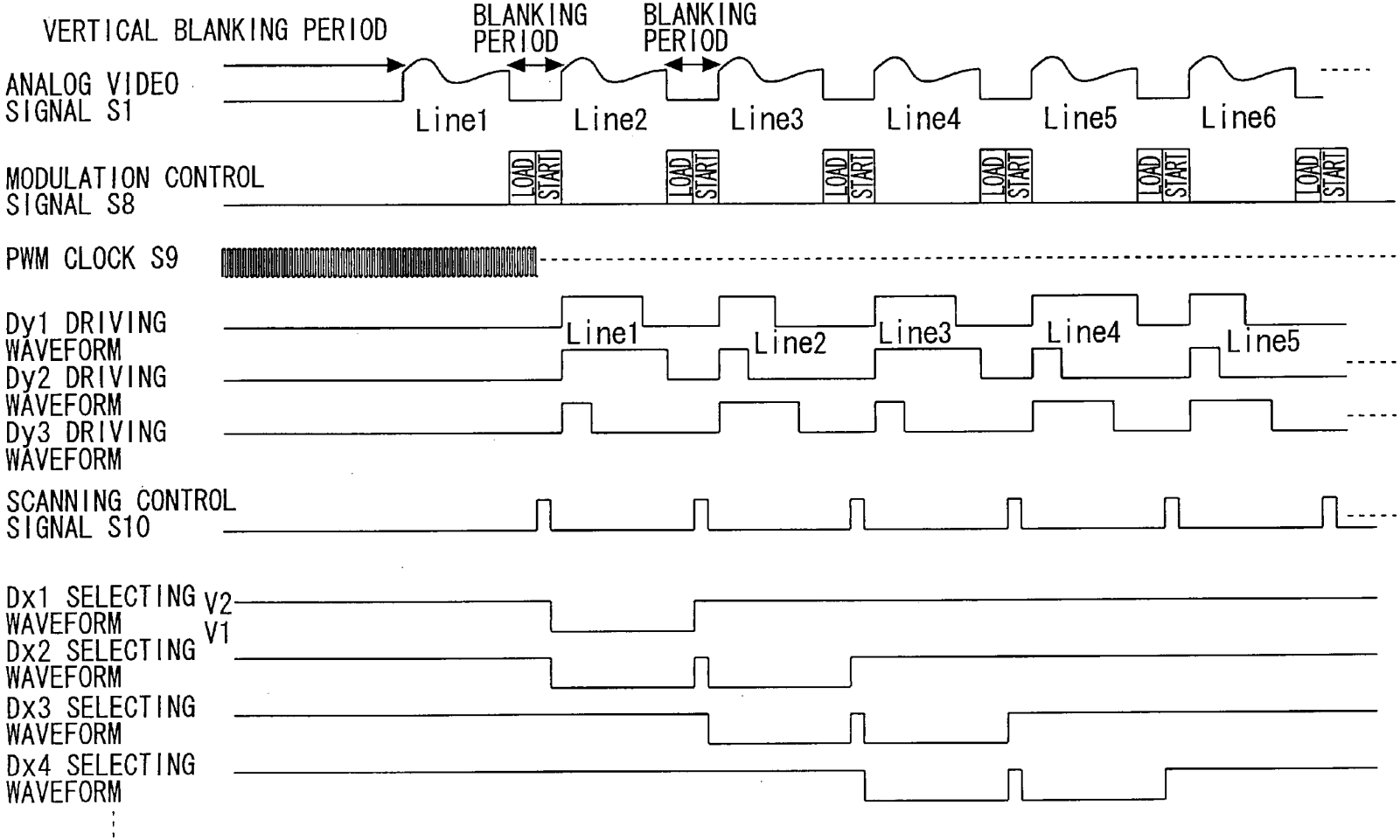
FIG. 2 is a timing chart of a repetitious scanning operation in the present invention.

For the application of a driving method for the display panel 1, two or more scanning lines Dx1 to Dxm are simultaneously driven and applied with a scanning selection potential V1 to activate them, and thereby two or more lines of pixels emit light simultaneously in dependence on the same display signal. In this way, the brightness of images displayed on the display panel 1 can be increased. The timing at this occasion is shown in FIG. 2.

Each scanning line Dxm is driven in such a manner that it is made active for two successive horizontal scanning periods and two lines of scanning lines are simultaneously selected for each horizontal scanning period. By so doing, it is possible to substantially double the brightness of the image displayed on the display panel (display means) 1. This driving manner for the first scan method will be hereinafter expressed as a "repetitious scan mode" (or "repetitious scan method"). On the other hand, there is another driving manner for the second scan method, in which only one line of the scanning lines is made active for one horizontal scanning period, and this driving manner will be expressed as a "normal scan mode" (or "normal scan method"). According to the present embodiment, these modes (or systems) can be selectively carried out.

Thus the repetitious scan mode can be realized only by changing the selection timing of the scanning lines, whereby the brightness of display in the image display apparatus can be much increased with a low cost.

Though a vertical resolution of the displayed image is reduced in the repetitious scan mode, it has not been clear what display characteristic the repetitious scan mode shows concretely.

Then, the present inventor has studied a display characteristic in the repetitious scan mode, and demonstrated the characteristic. The study contents will be described below.

FIG. 3 shows a conceptual diagram in the case of driving the display panel 1 in a normal scanning method. The reference numerals 1 to 6 are numbers given to the respective scanning lines, and the reference symbols "a" to "f" refer to image signals each for one line, corresponding to the respective scanning lines.

Now, if the video signal as represented in FIG. 3 is displayed in a driving manner of the repetitious scan mode, the display is made as represented in FIG. 4. From this figure, it can be seen that a component factor of the original scanning line appear even in a scanning line directly below the original scanning line. Appearance of each factor even in a subsequent period is considered to be equivalent to calculating of a filter of an impulse response (1, 1) in a vertical direction. Therefore, a vertical spatial frequency response characteristic in the vertical scan mode is considered to be a characteristic as shown in FIG. 5, for example, in the case of a display panel having 720 vertical scanning lines.

Figure 6:
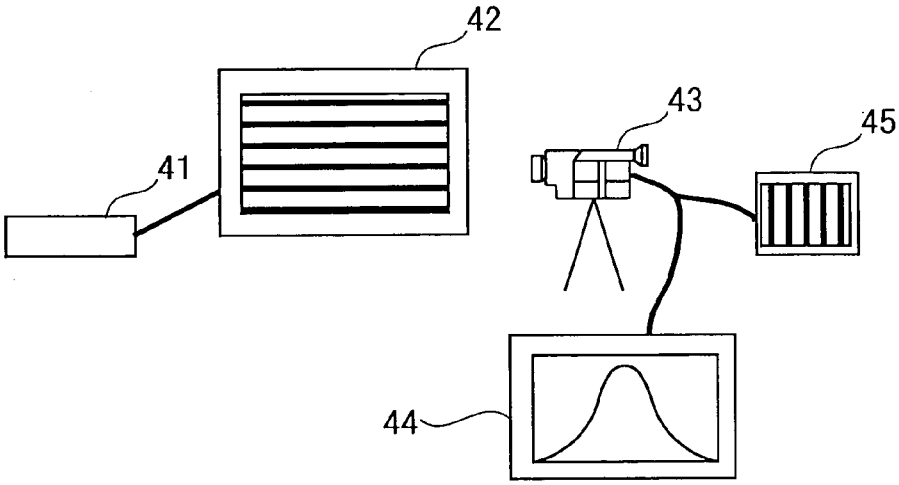
FIG. 6 is an illustration showing a measurement system for a vertical spatial frequency response characteristic.

Then, a vertical resolution of the display panel has been measured. FIG. 6 shows a conceptual view of a measurement system for a vertical spatial frequency response characteristic of the panel. A reference numeral 41 refers to a signal generator. A reference numeral 42 refers to a measured panel. A reference numeral 43 refers to a video camera. A reference numeral 44 refers to a spectral analyzer. A reference numeral 45 refers to an observational monitor.

Figure 7:
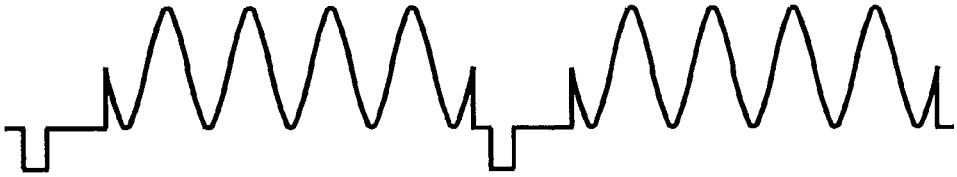
FIG. 7 is an illustration of an example of signal waveform measured by the measurement system shown in FIG. 6.

The signal generator 41 is made to generate a periodic waveform for a vertical direction (lateral stripes), and the waveform is displayed on the measured panel 42. The waveform is captured by the video camera 43, while the video camera 43 is inclined at 90° degree lateral. Then, a periodic waveform in a lateral direction (vertical stripes) is captured in the video camera 43, the captured video signal is a waveform as shown in FIG. 7, for example. When this signal is observed in the spectral analyzer 44, a spectrum corresponding to a periodic signal generated by the signal generator 41 is observed. A vertical spatial frequency response characteristic of the measured panel 42 can be measured by assuming a peak level of the spectrum as a response corresponding to the spatial frequency occurring in the signal generator 41 and sweeping the frequency occurring in the signal generator 41 to plot the responses.

Figure 5:
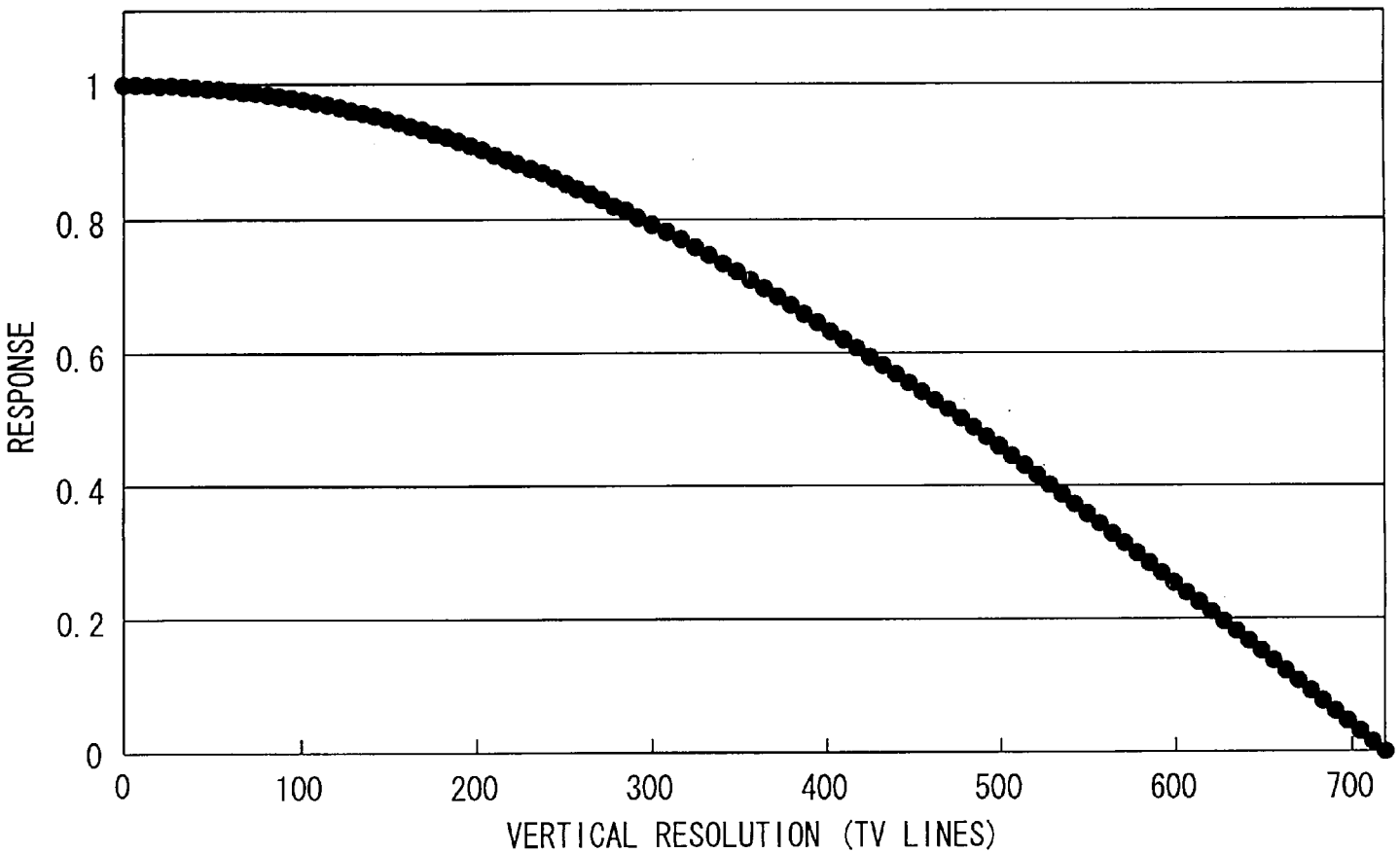
FIG. 5 is a graph indicating calculated values of a vertical spatial frequency response characteristic in a repetitious scan mode.
Figure 8:
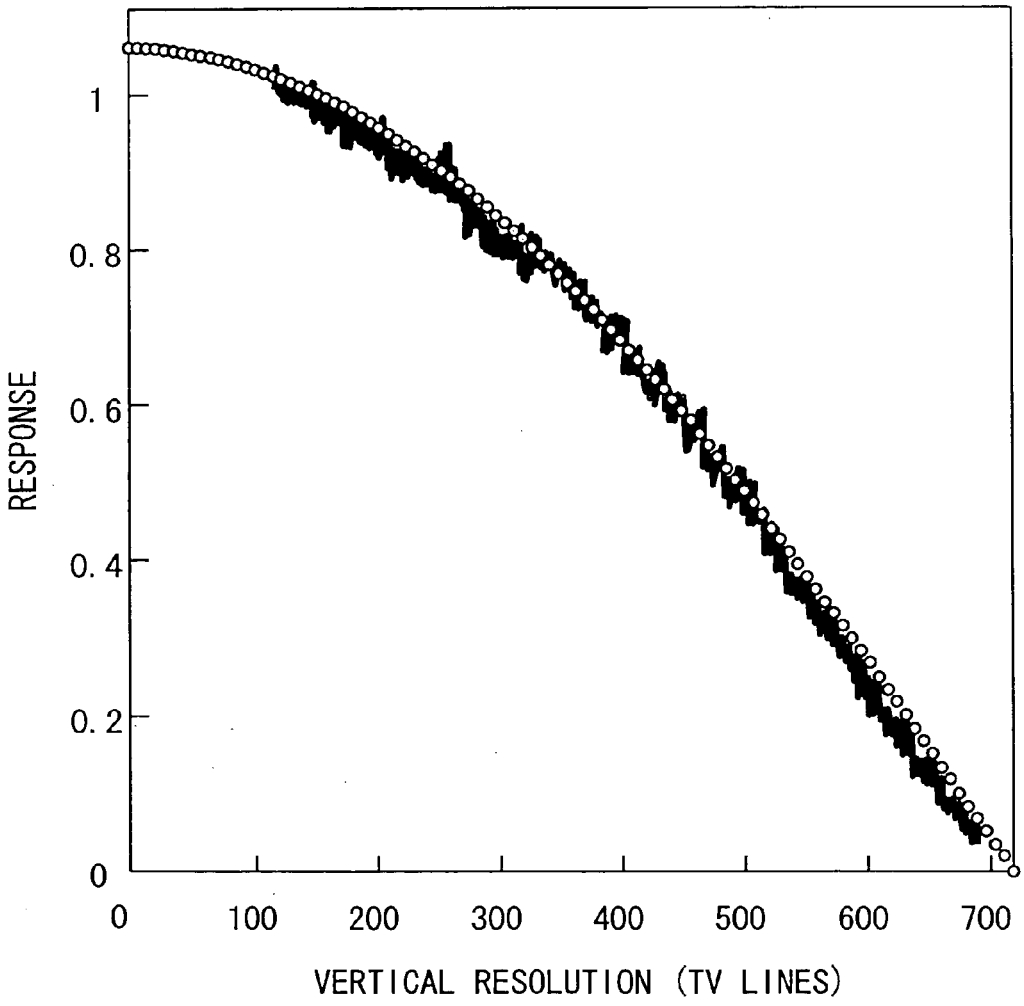
FIG. 8 is a graph indicating calculated values and actual measured values of a vertical spatial frequency response characteristic in a repetitious scan mode in combination with each other.

When the vertical spatial frequency response characteristic thus measured is overlaid on the calculated values shown in FIG. 5, the resultant forms as shown in FIG. 8, and it is seen that they are much identical. From this resultant, it has been concluded that a vertical spatial frequency response characteristic in the repetitious scan mode has a characteristic worth a vertical filter of an impulse response (1, 1).

As described above, the repetitious scan mode has a visual effect worth a vertical filter of an impulse response (1, 1) as compared with the case of the normal scan mode, leading to reduction of a vertical spatial resolution.

On the other hand, a display apparatus having a fixed pixel structure may often carry out a conversion of resolution for the purpose of adapting to any video signals in various specifications. In the conversion of resolution, there should be provided some filtering effect for eliminating jaggy possibly caused in the conversion.

With this being the situation, the present invention is intended to provide an optimal vertical spatial frequency response characteristic D' ( ) for the whole of the apparatus by changing a conversion parameter of the resolution converting section 7 in the repetitious scan mode to beforehand reduce the jaggy eliminating effect and combining such reduction with a filtering effect caused by the repetitious scan.

Therefore, a conversion parameter of the resolution converting section 7 is switched in accordance with either a normal scan or repetitious scan even in the case of the same input signal, and it is thereby possible to avoid a phenomenon in which a vertical spatial frequency response characteristic is changed on the occasion of mode-switching in an image display apparatus capable of switching between a normal scan and a repetitious scan.

Details about that will be described below. A book "*Considerable Understanding of Digital Image Processing*" (CQ publishing corp. published on Aug. 20, 1997, the third edition) can be consulted if necessary.

Figure 9:
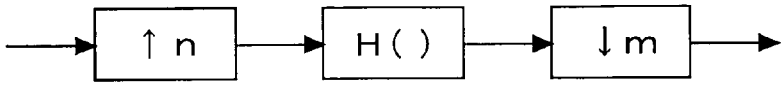
FIG. 9 is a block diagram showing a configuration of a resolution converting section.

In most cases, a conversion of resolution logically results in a configuration shown in FIG. 9, whatever configuration it actually has. A sign [↑n] refers to an n times up-sampler, [H( )] refers to a digital filter, [⇓m] refers to a 1/m down-sampler. In this configuration, resolution conversion of n/in times is obtained. In addition, a characteristic of H( ) can lead to the nearest neighbor function for interpolation of the same data, a bilinear function for making linear interpolation for two pieces of the original data, a bicubic function that is an interpolation method using the third order convolution, and other conversion characteristics. For example, the following are formulas in a ⅔ times resolution conversion:

$$H(\ )=(1, 1, 1, 1) \text{ [the nearest neighbor]}$$

$$H(\ )=(1, 2, 3, 4, 3, 2, 1) \text{ [the bilinear]}$$

$$H(\ )=(-5, -13, -14, 0, 30, 63, 89, 100, 89, 63, 30, 0, -14, -13, -5)\text{[the bicubic]} \quad \text{[Numeral Formula 1]}$$

In this formula, an expression of a well-known filter, H( ) is a progression of unnormalized impulse response and the same definition applies to the description hereinafter.

Figure 10:
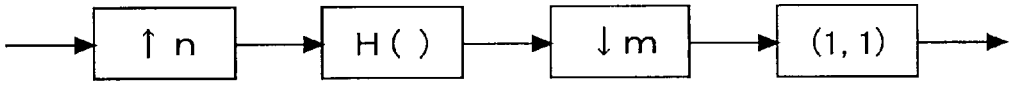
FIG. 10 is a block diagram showing an equivalent configuration in a vertical scan mode.

It has been described before that the repetitious scan mode has a visual effect corresponding to a vertical filter of (1, 1). Therefore, the repetitious scan mode can be considered to be equivalent to a mode in which a signal processing is performed as shown in FIG. 10 in the repetitious scan mode. In this situation, $$J(m)=(1, Z(m-1), Z(m-2), \ldots, Z(1), 1), \text{ where } Z(x)=0. \quad \text{[Numeral Formula 2]}$$

$$J(1)=(1, 1)$$

$$J(2)=(1, 0, 1)$$

$$J(4)=(1, 0, 0, 0, 1) \quad \text{[Numeral Formula 3]}$$

Figure 11:
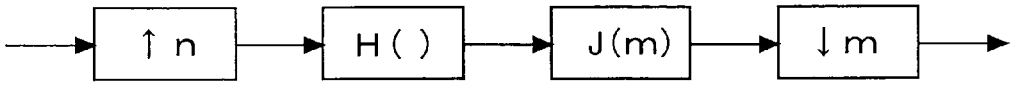
FIG. 11 is a block diagram showing another equivalent configuration in a vertical scan mode.

For example, if these equations of Formula 3 hold, FIG. 10 is made equivalent to FIG. 11.

From these conditions, it is seen that the same vertical spatial resolution characteristic D( ), D'( ) can be obtained even in either the normal scan mode or the repetitious scan mode by determining H'( ) to satisfy the following formula, $$H(\ )=H'(\ )\cdot J(m) \quad \text{[Numeral Formula 4]}$$

and performing a resolution conversion using H'( ) for H( ) in the repetitious scan mode.

H' ( ) can be obtained specifically as follows.

$$H(\ )=(h(1), {}^{h}(2), {}^{h}(3), \ldots)$$

$$H'(\ )=(h'(1), h'(2), h'(3), \ldots)$$

$$J(\ )=(j(1), j(2), j(3), \ldots) \quad \text{[Numeral Formula 5]}$$

If the above equations are assumed, then they can be expanded as follows on the basis of H( )=H'( )·J( ).

$$h(1)=h'(1)j(1)$$

$$h(2)h'(2)j(1)+h'(1)j(2)$$

$$h(3)=h'(3)j(1)+h'(2)j(2)+h'(1)j(3)$$

$$h(4)=h'(4)j(1)+h'(3)j(2)+h'(2)j(3)+h'(1)j(4)$$

$$\ldots$$

$$h(x)=h'(x)j(1)+h'(x-1)j(2)+h'(x-2)j(3)+\ldots+h'(1)j(x) \quad \text{[Numeral Formula 6]}$$

So, these equations should be solved.

Next, an example will be given as to the case of magnification of resolution conversion (n/m)=4/3 and H( )=(1, 2, 3, 4, 4, 4, 3, 2, 1). Because of m=3, J( )=(1, 0, 0, 1) holds. Hence, $$h(1)=h'(1)=1$$

$$h(2)=h'(2)=2$$

$$h(3)=h'(3)=3$$

$$h(4)=h'(4)+h'(1)=4$$

$$h(5)=h'(5)+h'(2)=4$$

$$h(6)=h'(6)+h'(3)=4$$

$$h(7)=h'(7)+h'(4)=3$$

$$h(8)=h'(8)+h'(5)=2$$

$$h(9)=h'(9)+h'(6)=1 \quad \text{[Numeral Formula 7]}$$

From these equations, the next formula holds.

$$H'(\ )=(1, 2, 3, 3, 2, 1) \quad \text{[Numeral Formula 8]}$$

Figure 12:
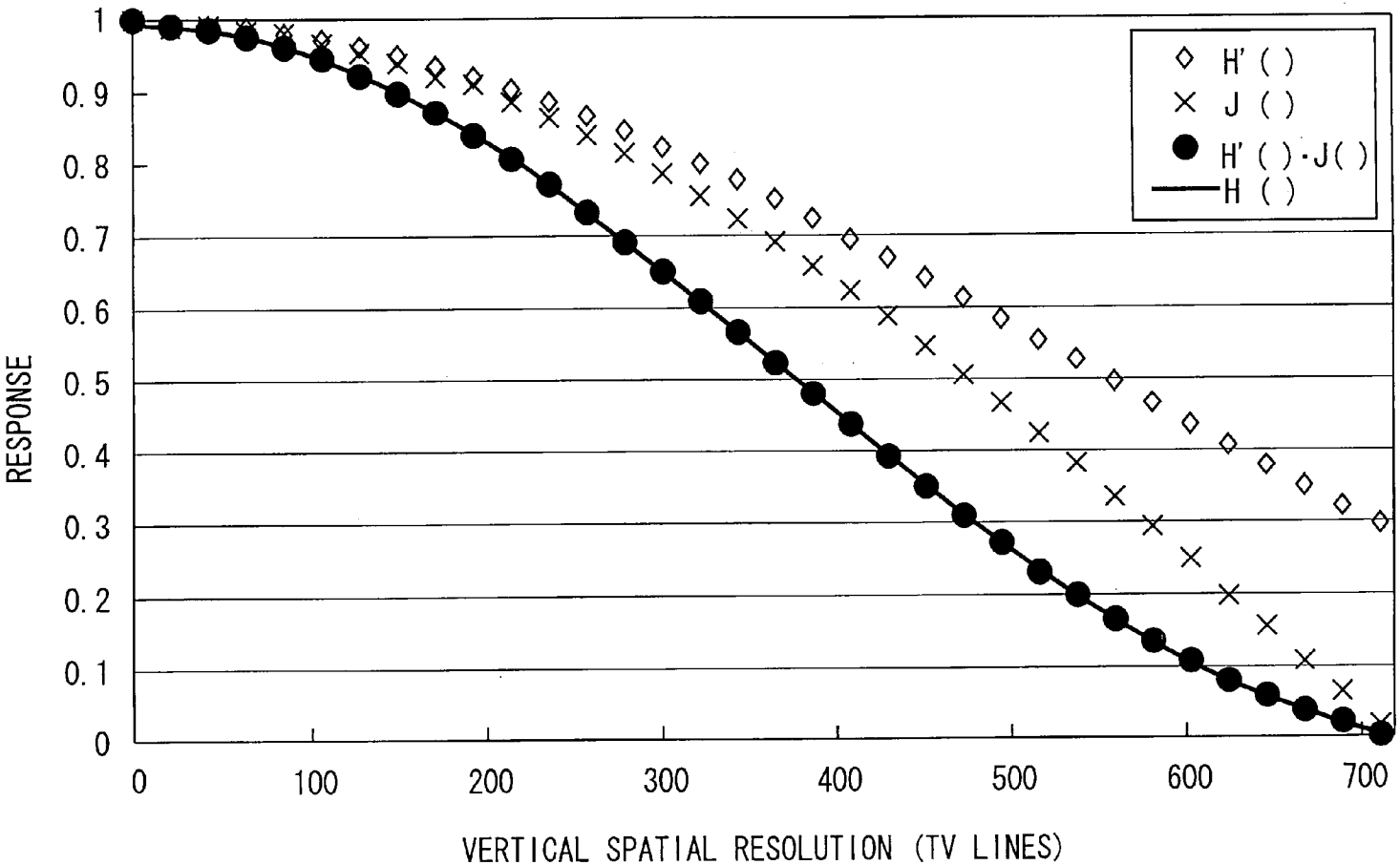
FIG. 12 is a graph indicating spatial frequency characteristics in a first embodiment.

FIG. 12 shows a vertical spatial frequency characteristic of the filters of H( ), H'( ), J( ), H'( )·J( ). In this case, H( )=H'( )·J( ). Namely, it is found that: by performing a resolution conversion using H( ) in the normal scan mode and H'( ) in the repetitious scan mode, substantially the same vertical spatial frequency characteristic D( ), D'( ) can be acquired in both cases of the modes to make it possible to visually cancel deterioration of resolution possibly caused by the repetitious scan.

In this way, a conversion parameter of the resolution converting section 7 in the repetitious scan mode is changed to beforehand reduce the eliminating effect on the high frequency components, and thereby it is possible to set an optimal vertical spatial frequency response characteristic of the whole apparatus in combination of such reduction with a filtering effect caused by the repetitious scan.

Therefore, a conversion parameter of the resolution converting section 7 is switched in accordance with either a normal scan mode or a repetitious scan mode even in the case of the same input signal, and it is thereby possible to avoid a phenomenon in which a vertical spatial frequency response characteristic D( ), D'( ) is changed on the occasion of mode-switching in an image display apparatus capable of switching between a normal scan and a repetitious scan, resulting in D( )=D'( ).

Second Embodiment

In the first embodiment, there is the case where the calculation of H'( ) does not converge on a finite progression, depending on the original H( ). Even in such a case, the present invention is applicable by subjecting the way of calculating H'( ) to correction.

Furthermore, even if the resolution converting method is expressed in form of a weighting function such as a bicubic method, the invention is applicable by expanding the function to an impulse response progression.

This will be described hereinafter by way of example of a resolution conversion based on the bicubic method.

A weighting function W(d) in the bicubic method is represented as follows, where d is a distance between an input sample point and an output sample point.

$$W(d)=(d-1)(d\hat{}2-d-1)\text{[a first vicinity]}$$

$$W(d)=-(d-1)(d-2)\hat{}2\text{[a second vicinity]} \quad \text{[Numeral Formula 9]}$$

Herein, X^2 means the second power to X, and the same applies to the below-mentioned expression. If these equations are expressed on the basis of an abscissa (x) of output sample points with an input sample point being the origin, the following formula is obtained.

$W(x)=0[x<-2]$ $W(x)=(x+1)(x+2)^2[-2=x=-1]$ $W(x)=-(x+1)(x^2+x-1)[-1=x=0]$ $W(x)=(x-1)(x^2-x-1)[0=x=1]$ $W(x)=(-x+1)(-x+2)^2[1=x=2]$ $W(x)=0[2<x]$ [Numeral Formula 10]

In the case of n/m times resolution conversion, an impulse response progression H( ) of the filter is obtained by sampling this W(x) at a 1/n period. For example, in the case of 3/2 times, the following holds, where the values are rounded off to two decimal places.

$H(\ )=(-0.07, -0.15, 0.00, 0.40, 0.82, 1.00, 0.82, 0.40, 0.00, -0.15, -0.07)$ [Numeral Formula 11]

From this progression, calculation of H'( ) according to the method described in the first embodiment reaches the following formula, and it will not converge.

$H'(\ )=(-0.07, -0.15, 0.07, 0.55, 0.75, 0.45, 0.07, -0.05, -0.07, -0.10, 0.00, 0.10, 0.00, -0.10, 0.00, 0.10, 0.00, -0.10, \ldots)$ [Numeral Formula 12]

In such a case, the number of the factors of H'( ) should be limited to N(H)−m using a function N( ) representing the number of factors of the progression. In this example, the number of factors of H'( ) is limited to 9 (that is, 11−2) to be approximated to the following progression.

$H''(\ )=(-0.07, -0.15, 0.07, 0.55, 0.75, 0.45, 0.07, -0.05, -0.07)$ [Numeral Formula 13]

By doing so, H"( ) is determined to be finite, but, on the other hand, H"( ) has possibility to be an asymmetry progression. Besides, H( ) and H"( )·J(m) may be out of coincidence. With this being the situation, H"( ) is corrected as follows.

$H'''(\ )=(h'(1), h'(2), \ldots, h'((N(H')+1)/2)-1, h'((N(H')+1)/2), h'((N(H')+1)/2-1, \ldots, h'(1))$ [in the case where $N(H')$ is an odd number]

$H'''(\ )=(h'(1), h'(2), \ldots, h'(N(H')/2)-1, h'(N(H')/2), h'(N(H')/2), h'(N(H')/2)-1, \ldots, h'(1))$ [in the case where $N(H')$ is an even number] [Numeral Formula 14]

For example, correction is made by the following formula.

$H'''(\ )=(h'(1), h'(2), h'(3), h'(2), h'(1))$ [in the case of $N(H')=5$]

$H'''(\ )=(h'(1), h'(2), h'(3), h'(3), h'(2), h'(1))$ [in the case of $N(H')=6$] [Numeral Formula 15]

In the case of the current example, $H'(\ )=(-0.07, -0.15, 0.07, 0.55, 0.75, 0.45, 0.07, 0.15, 0.07, \ldots)$ [Numeral Formula 16]

Therefore, the next formula can be adopted.

$H'''(\ )=(-0.07, -0.15, 0.07, 0.55, 0.75, 0.55, 0.07, -0.15, -0.07)$ [Numeral Formula 17]

When H'( )is in convergence, H'( )=H'''( ) and when H'( ) is not in convergence, H( ) and H'''( )·J(m) make relatively good coincidence. For these reasons, use of H'''( ) is preferable in practice.

Other construction etc. of the image display apparatus is much the same as in the first embodiment, so the details will be omitted.

Figure 13:
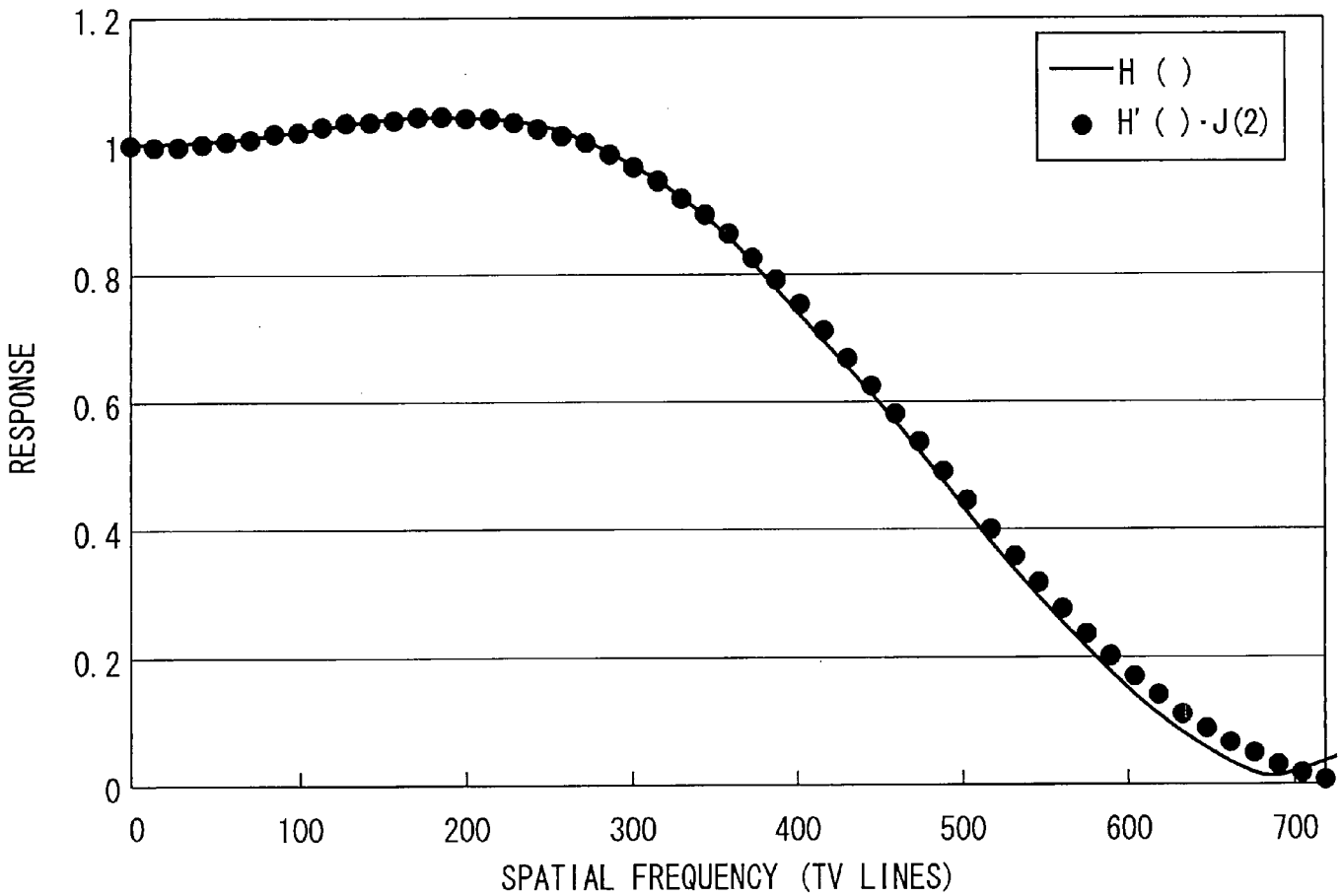
FIG. 13 is a graph indicating a spatial frequency characteristic in a second embodiment.

FIG. 13 shows the spatial frequency characteristics of H( ) and H'''( )·J(2) just obtained in the case of 3/2 times in the bicubic method. It can be seen that H( ) nearly equals H'''( )·J(2), and that the repetitious scan mode can also offer almost the same vertical spatial frequency characteristic as that in the bicubic method in the normal scan mode. Thus, a vertical spatial frequency characteristic D'( ) of the image display apparatus in the overlap scan method and a vertical spatial frequency characteristic D( ) of the same in the normal scan method can be set to D( )=D'( ).

Furthermore, instead of H( ), H'''( )·J( ) may be used in the normal scan mode. In this case, the converting characteristic is closely analogous to the bicubic, but there is no change of characteristic due to the switching between the normal scan and the repetitious scan.

In addition, the present invention can be implemented in the same way even in other systems including the bilinear method system.

Naturally, the present invention can be-implemented based on a practical configuration of the resolution converting section 7, in which the filter theory is brought into circuitry (method) with fidelity as shown in FIG. 9, or in which a weighting function and/or a weighting table based on H'''( ) herein obtained are/is used to configure the circuit (method).

Third Embodiment

Implementation may be made in a configuration in which a resolution conversion parameter in the resolution converting section is fixed against the switching of the scan mode and on the other hand a characteristic of the vertical filter that is provided separately is switched between the normal scan and the repetitious scan.

Figure 14:
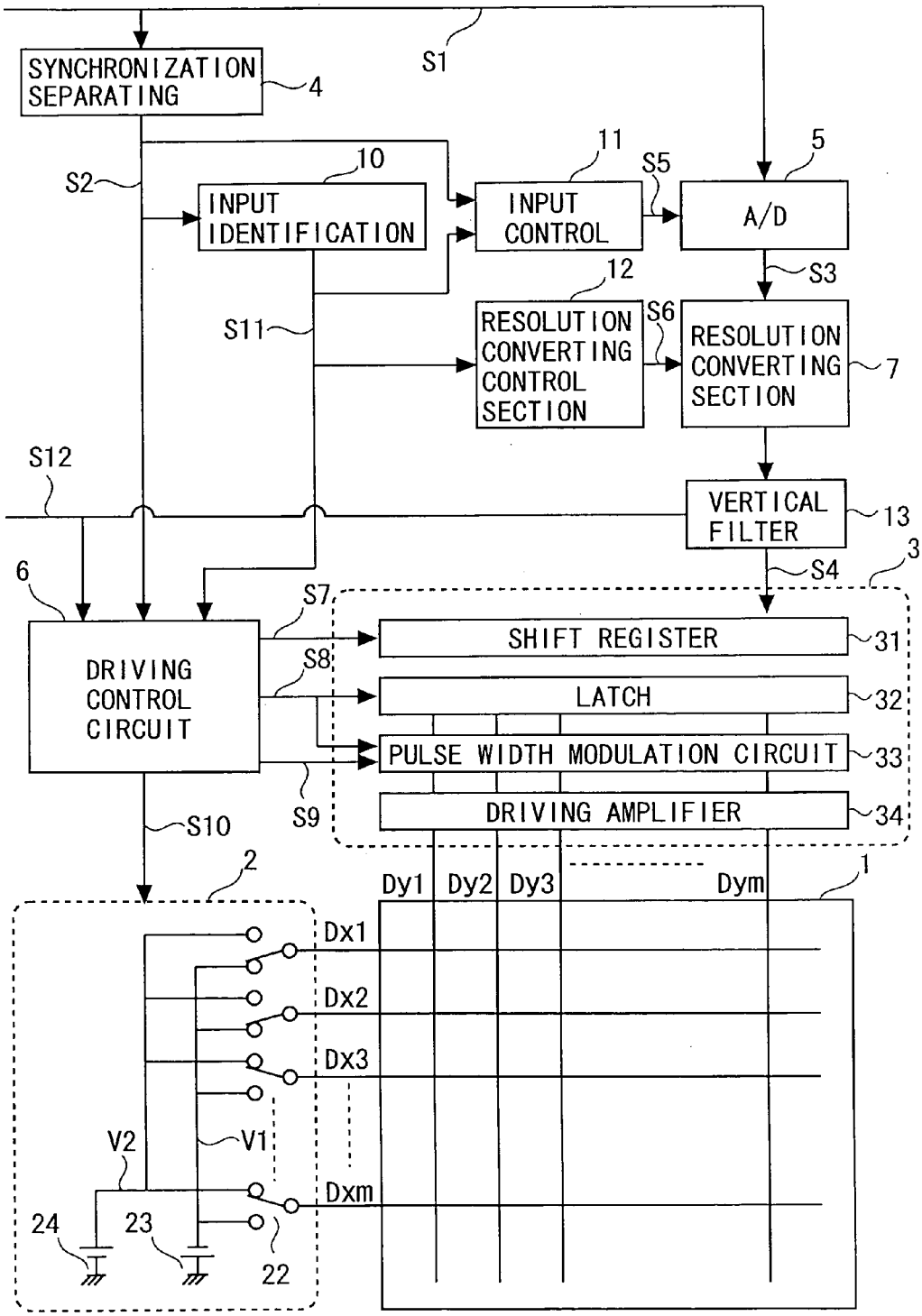
FIG. 14 is a constructional diagram of an image display apparatus in a third embodiment.

FIG. 14 shows a configuration of an image display apparatus in the third embodiment. A reference numeral 13 is a vertical filter capable of changing its characteristic. The filter changes its vertical filtering characteristic in accordance with a switching signal S12 for the normal scan and the repetitious scan. The resolution converting control section 12 determines the changing parameter in accordance with only the video type signal S11. Other configuration and operation is the same or much the same as those in the first embodiment.

The resolution converting control section 12 always outputs H'''( ) mentioned in the second embodiment as a converting parameter irrespective of the scan mode. The vertical filter 13 performs vertical filtering to eliminate high frequency components of (1, 1) in accordance with the switching signal S12 during the normal scanning operation and performs no filtering during the repetitious scanning operation. By so doing, the equivalent signal is outputted for the display signal S4, the equivalent signal being obtained when a resolution conversion is made with H'''( )·J( ) in the normal scanning and with H'''( ) in the repetitious scanning.

That is, this configuration can also acquire the optimal spatial frequency characteristics D( ), D'( ) regardless of whether it is the normal scanning or the repetitious scanning in the same way as in the first and second embodiments.

Fourth Embodiment

In the above there has been described an example in which the present invention is applied to an image display apparatus that switches between the normal scan mode and the repetitious scan mode, but it is possible to provide an optimal vertical spatial frequency response characteristic much similar to that provided in an image display apparatus in the normal scan mode even in an image display apparatus that can provide only a repetitious scan mode by using the resolution conversion parameter according to the present invention.

A configuration of the apparatus refers to the image display apparatus in the first embodiment shown in FIG. 8. Except that a switching signal S12 for switching between the normal scan and the repetitious scan is always in the repetitious scan mode, the present invention can be applied to an image display apparatus that only provides a repetitious scan mode, as is the case with a configuration of the image display apparatus in the first embodiment. A repetitious scan method used in the present invention merely requires pixels on a plurality of scanning lines to be active at the same time, and covers the case where pixels on a common scanning line are not active during two successive horizontal scanning periods.

As described above, according to the present invention, an image display apparatus that can switch between a repetitious scan method and a normal scan method can provide much the same vertical spatial frequency response characteristic as that in the normal scan method even during the operation in the repetitious scan method, and thereby an image display apparatus can be provided with a bright and high quality image and with low cost.

In addition, an image display apparatus that performs scanning only based on a repetitious scan method can also provide an optimal vertical spatial frequency response characteristic similar to that in an image display apparatus in a normal scan method, and thereby an image display apparatus can be inexpensively offered with a bright and high quality image.

What is claimed is:

1. An image display apparatus comprising:

image display means including scanning lines, modulation lines and display devices driven through said scanning lines and modulation lines;

a scanning circuit for supplying a scanning signal to said scanning line;

a modulation circuit for supplying a modulation signal to said modulation line;

a converting circuit for converting the number of scanning lines of an input image signal;

selecting means for selecting a scan method of any of a first scan method and a second scan method, the first scan method being adapted to simultaneously select a plurality of adjacent scanning lines during one selection period and select the same scanning line twice or more within one frame while a set of scanning lines to be simultaneously selected is changed, the second scan method being adapted to select one scanning line during one selection period and select the same scanning line only once within one frame; and changing means for changing a vertical scaling filter characteristic of said converting circuit in accordance with the selected scan method, wherein said vertical scaling filter characteristic in the case of said first scan method is a characteristic having a weaker elimination effect on high frequency components as compared with said vertical scaling filter characteristic in the case of said second scan method.

2. An image display apparatus as defined in claim 1, wherein said changing means determines H'( ) to satisfy H( )=H'( )·J( ) or substantially H( )=H'( )·J( ), where H( ) is said vertical scaling filter characteristic in the case of said second scan method, H'( ) is said vertical scaling filter characteristic in the case of said first scan method and J( ) is a vertical spatial frequency characteristic reduced in the case of said first scan method.

3. An image display apparatus comprising:

image display means including scanning lines, modulation lines and display devices driven through said scanning lines and modulation lines;

a scanning circuit for supplying a scanning signal to said scanning line;

a modulating circuit for supplying a modulation signal to said modulation line;

selecting means for selecting a scan method of any of a first scan method and a second scan method, the first scan method being adapted to simultaneously select a plurality of adjacent scanning lines during one selection period and select the same scanning line twice or more within one frame while a set of scanning lines to be simultaneously selected is changed, the second scan method being adapted to select one scanning line during one selection period and select the same scanning line only once within one frame;

a filter circuit for executing, to image data to be displayed in said image display means, a filtering processing for eliminating high frequency components and supplying the processed data to said modulation circuit; and changing means for changing an elimination effect on the high frequency components in said filter circuit in accordance with the selected scan method, wherein a characteristic of said filter circuit in the case of said first scan method is a characteristic having a weaker elimination effect on high frequency components as compared with a characteristic of said filter circuit in said second scan method.

4. An image display apparatus as defined in claim 3, wherein said changing means determines a characteristic of said filter circuit to satisfy D( )=D'( ) or substantially D( )=D'( ), where D( ) is the vertical spatial frequency characteristic of said image display apparatus in the case of said second scan method and D'( ) is the vertical spatial frequency characteristic of said image display apparatus in the case of said first scan method.

5. An image display apparatus comprising:

image display means including scanning lines, modulation lines and display devices driven through said scanning lines and modulation lines;

a scanning circuit for supplying a scanning signal to said scanning line;

a modulating circuit for supplying a modulation signal to said modulation line; and a converting circuit for converting the number of scanning lines of an input image signal, wherein a characteristic H'( ) of said converting circuit is determined such that characteristics D( ) and D'( ) are substantially identical with each other, where D( ) is a vertical spatial frequency characteristic of said image display apparatus which is obtained in a second scan method that is adapted to select one scanning line during one selection period and select the same scanning line only once within one frame, and D'( ) is a vertical spatial frequency characteristic of said image display apparatus which is obtained in a first scan method that is adapted to simultaneously select a plurality of adjacent scanning lines during one selection period and select the same scanning line twice or more within one frame while a set of scanning lines to be simultaneously selected is being changed.

6. An image display apparatus comprising:

image display means including scanning lines, modulation lines and display devices driven through said scanning lines and modulation lines;

a scanning circuit for supplying a scanning signal to said scanning line;

a modulating circuit for supplying a modulation signal to said modulation line; and a converting circuit for converting the number of scanning lines of an input image signal, wherein a characteristic of H'( ) of said converting circuit is determined to satisfy H( )=H'( )·J( )or substantially H( )=H'( )·J( ),where H( ) is a characteristic of said converting circuit which is used in a second scan method that is adapted to select one scanning line during one selection period and select the same scanning line only once within one frame, H'( ) is a characteristic of said converting circuit which is used in a first scan method that is adapted to simultaneously select a plurality of adjacent scanning lines during one selection period and select the same scanning line twice or more within one frame while a set of scanning lines to be simultaneously selected is changed, and J( ) is a degradation characteristic of vertical spatial resolution in the same case of said first scan method as compared with the case of said second scan method.

7. An image display apparatus as defined in any one of claims 1 to 6, wherein said display means have display devices at intersections of said scanning lines and said modulation lines, the display devices being one kind of devices selected from electro-emission device, EL device and plasma device.

8. A method for determination of characteristics in an image display apparatus comprising:

image display means including scanning lines, modulation lines and display devices driven through said scanning lines and modulation lines;

a scanning circuit for supplying a scanning signal to said scanning line;

a modulating circuit for supplying a modulation signal to said modulation line;

a converting circuit for converting the number of scanning lines of an input image signal, wherein a characteristic H'( ) of said converting circuit is determined to satisfy H( )=H'( )·J( ), where H( ) is a characteristic of said converting circuit which is used in a second scan method that is adapted to select one scanning line during one selection period and select the same scanning line only once within one frame, H'( ) is a characteristic of said converting circuit which is used in a first scan method that is adapted to simultaneously select a plurality of adjacent scanning lines during one selection period and select the same scanning line twice or more within one frame while a set of scanning lines to be simultaneously selected is changed, and J( ) is a degradation characteristic of vertical spatial resolution in the same case of said first scan method as compared with the case of said second scan method.

9. A method for determination of characteristics in an image display apparatus comprising:

image display means including scanning lines, modulation lines and display devices driven through said scanning lines and modulation lines;

a scanning circuit for supplying a scanning signal to said scanning line;

a modulating circuit for supplying a modulation signal to said modulation line;

a converting circuit for converting the number of scanning lines of an input image signal, wherein a characteristic H'( ) of said converting circuit is determined to satisfy substantially H( )=H'( )·J( ), where H( ) is a characteristic of said converting circuit which is used in a second scan method that is intended to select one scanning line during one selection period and select the same scanning line only once within one frame, H'( ) is a characteristic of said converting circuit which is used in a first scan method that is adapted to simultaneously select a plurality of adjacent scanning lines during one selection period and select the same scanning line twice or more within one frame while a set of scanning lines to be simultaneously selected is changed, and J( ) is a degradation characteristic of vertical spatial resolution in the same case of said first scan method as compared with the case of said second scan method.

* * * * *

UNITED STATES PATENT AND TRADEMARK OFFICE

CERTIFICATE OF CORRECTION

PATENT NO. : 7,227,541 B2
APPLICATION NO. : 10/762335
DATED : June 5, 2007
INVENTOR(S) : Muneki Ando It is certified that error appears in the above-identified patent and that said Letters Patent is hereby corrected as shown below:

COLUMN 1:

Line 24, “showed.” should read --shown.--.

COLUMN 6:

Line 61, “[⇓m]” should read --[↓m]--.

Line 62, “n/in” should read --n/m--.

COLUMN 7:

Line 39, “H( )=(h(1), $^{h}$(2), $^{h}$(3), . . .)” should read --H( )=(h(1), h(2), h(3), . . .)--.

COLUMN 9:

Line 57, “H’( )=(-0.07,-0.15, 0.07, 0.55, 0.75, 0.45, 0.07, 0.15, 0.07, . . .)” should read --H’( )=(-0.07, -0.15, 0.07, 0.55, 0.75, 0.45, 0.07, -0.15, -0.07, . . .)--.

COLUMN 10:

Line 22, “be-implemented” should read --be implemented--.

UNITED STATES PATENT AND TRADEMARK OFFICE

CERTIFICATE OF CORRECTION

PATENT NO. : 7,227,541 B2
APPLICATION NO. : 10/762335
DATED : June 5, 2007
INVENTOR(S) : Muneki Ando It is certified that error appears in the above-identified patent and that said Letters Patent is hereby corrected as shown below:

COLUMN 11:

Line 44, "modulation" should read --modulating--.

Signed and Sealed this

Twenty-eighth Day of October, 2008

JON W. DUDAS
*Director of the United States Patent and Trademark Office*